US005302038A

United States Patent [19]

Hirono et al.

[11] Patent Number: 5,302,038

[45] Date of Patent: Apr. 12, 1994

[54] TAPE PRINTING DEVICE FOR PRINTING A PLURALITY OF PRINTING LINES ACROSS THE WIDTH OF A TAPE

[75] Inventors: Kazuhisa Hirono; Yasuyo Ooshio; Takashi Ito, all of Nagoya, Japan

[73] Assignee: Brother Kogyo Kabushiki Kaisha, Nagoya, Japan

[21] Appl. No.: 831,971

[22] Filed: Feb. 6, 1992

[30] Foreign Application Priority Data

Mar. 28, 1991 [JP] Japan ..... 3-91492

[51] Int. Cl.[5] ..... B41J 15/00

[52] U.S. Cl. ..... 400/615.2

[58] Field of Search ..... 400/120, 615.2, 121, 400/124

[56] References Cited

U.S. PATENT DOCUMENTS

| | | | |
|---|---|---|---|
| 3,931,761 | 1/1976 | Carrus et al. | 400/120 |
| 4,408,907 | 10/1983 | Bernardis | 400/124 |
| 4,484,826 | 11/1984 | Horn et al. | 400/279 |
| 4,927,278 | 5/1990 | Kuzuya et al. | 400/208 |
| 5,069,557 | 12/1991 | Kuzuya et al. | 400/120 |

FOREIGN PATENT DOCUMENTS

| | | | |
|---|---|---|---|
| 0364305A2 | 4/1990 | European Pat. Off. | 400/615.2 |
| 29679 | 2/1983 | Japan | 400/615.2 |
| 62-128774 | 6/1987 | Japan | 400/68 |
| 1-152070 | 6/1989 | Japan | 400/615.2 |
| 1-152070(A) | 6/1989 | Japan | 400/615.2 |
| 2-106555(A) | 4/1990 | Japan | 400/615.2 |
| 2154774 | 9/1985 | United Kingdom | 400/61 |

*Primary Examiner*—David A. Wiecking
*Assistant Examiner*—Steven S. Kelley
*Attorney, Agent, or Firm*—Oliff & Berridge

[57] ABSTRACT

Operation of a double-line printing key, and selection of an upper printing line or a lower printing line causes the indication of subsequent input character data to follow either an upper printing line mark or a lower printing line mark, for example, on an LCD. When a printing key is operated, the character data following the upper printing line mark are stored in a first arrangement memory, and the data following the lower printing line mark are stored in a second arrangement memory. When the number of characters to be printed in the upper line is different from the number of characters to be printed in the lower line, space data are inserted into the printing line (upper or lower) which has the lesser number of characters so that the length of the upper printing line and the lower printing line become the same. Then, characters are printed on the upper and lower lines of the printing tape based on the data stored in the first and the second arrangement memories so that characters in the lower printing line are directly below characters in the upper printing line.

24 Claims, 21 Drawing Sheets

FIG. 5B

| ITEM | INSTRUCTION |
|---|---|
| S1 | INITIALIZE |
| S2 | KEY INPUT? |
| S3 | SETTING KEY OPERATED? |
| S4 | DOUBLE-LINE PRINTING KEY OPERATED? |
| S5 | DISPLAY FIRST SELECTED SETTING FOR DOUBLE-LINE PRINTING |
| S6 | F1 ← 1 |
| S7 | SINGLE-LINE PRINTING KEY OPERATED? |
| S8 | DISPLAY SINGLE-LINE PRINTING MARK > AND STORE SINGLE-LINE PRINTING COMMAND DATA |
| S9 | F1 ← 0 |
| S10 | PRINTING KEY OPERATED? |
| S11 | PERFORM PRINTING PROCESS |
| S12 | PERFORM PROCESS CORRESPONDING TO OPERATED KEY |

FIG. 6B

| ITEM | INSTRUCTION |
|---|---|
| S13 | CHANGE IN ENS? |
| S14 | F1 = 1? |
| S15 | DISPLAY NEXT SELECTED SETTING FOR DOUBLE-LINE PRINTING |
| S16 | UPPER PRINTING LINE? |
| S17 | F2 ← 1 |
| S18 | F2 ← 0 |
| S19 | F3 = 1? |
| S20 | DISPLAY NEXT SELECTED SETTING FOR PRINTING BASE LINE POSITION CHANGE |
| S21 | ANY BASE LINE POSITION CHANGED? |
| S22 | F4 ← 1 |
| S23 | F4 ← 0 |
| S24 | F5 = 1? |
| S25 | DISPLAY NEXT SELECTED SETTING FOR PRINTING BASE LINE POSITION |
| S26 | ANOTHER FLAG SET? |
| S27 | DISPLAY NEXT SELECTED SETTING CORRESPONDING TO THE FLAG |
| S28 | DISPLAY CHARACTER CORRESPONDING TO DIAL ROTATION POSITION |

FIG. 7B

| ITEM | INSTRUCTION |
|---|---|
| S29 | F1 = 1? |
| S30 | F2 = 1? |
| S31 | DISPLAY UPPER PRINT LINE MARK "△" |
| S32 | DISPLAY LOWER PRINT LINE MARK "▽" |
| S33 | F1 ← 0 |
| S34 | DISPLAY SELECTED SETTING FOR PRINTING BASE LINE POSITION CHANGE |
| S35 | F3 ← 1 |
| S36 | F3 = 1? |
| S37 | F3 ← 0 |
| S38 | F4 = 1? |
| S39 | DISPLAY FIRST SELECTED SETTING FOR PRINTING BASE LINE POSITION |
| S40 | F5 ← 1 |
| S41 | F5 = 1? |
| S42 | INCLUDE PRINTING BASE LINE POSITION CHANGE AMOUNT DATA INTO PRINTING COMMAND DATA |
| S43 | F5 ← 0 |
| S44 | ANOTHER FLAG SET? |
| S45 | ESTABLISH SETTING CORRESPONDING TO FLAG |
| S46 | STORE CODE DATA INTO DATA BUFFER |

FIG. 8B

| ITEM | INSTRUCTION |
|---|---|
| S50 | INITIALIZE |
| S51 | PERFORM ARRANGEMENT PROCESS |
| S52 | SET FIRST ADDRESS IN FIRST ARRANGEMENT MEMORY TO FIRST POINTER |
| S53 | READ DATA |
| S54 | END OF DATA? |
| S55 | CODE DATA? |
| S56 | ">" CODE? |
| S57 | F1 ← 0 |
| S58 | F1 ← 1 |
| S59 | STORE CHARACTER WIDTH VALUE |
| S60 | INCREMENT FIRST POINTER |
| S61 | SET CHARACTER SPACING VALUE CORRESPONDING TO CHARACTER SIZE |
| S62 | F1 = 1? |
| S63 | STORE DOT PATTERN DATA INTO PRINTING BUFFER |
| S64 | PERFORM DATA REVISING PROCESS |
| S65 | PERFORM CHARACTER PRINTING PROCESS |

FIG. 9B

| ITEM | INSTRUCTION |
|---|---|
| S70 | STORE CODE DATA FROM INPUT DATA BUFFER INTO FIRST ARRANGEMENT MEMORY |
| S71 | SET FIRST ADDRESS IN FIRST ARRANGEMENT MEMORY TO FIRST POINTER |
| S72 | READ CODE DATA OF FIRST POINTER |
| S73 | "▵" DATA? |
| S74 | SEARCH THROUGH FIRST ARRANGEMENT MEMORY |
| S75 | "▿" DATA? |
| S76 | SET "▿" DATA AND SUBSEQUENT CONTIGUOUS CODE DATA TO CORRESPONDING ADDRESSES IN SECOND ARRANGEMENT MEMORY |
| S77 | STORE SPACE INTO SECOND ARRANGEMENT MEMORY |
| S78 | UDN > LDN? |
| S79 | STORE SPACE INTO SECOND ARRANGEMENT MEMORY |
| S80 | UDN = LDN? |
| S81 | STORE SPACE INTO FIRST ARRANGEMENT MEMORY |
| S82 | ARRANGE CONTENTS OF FIRST ARRANGEMENT MEMORY |
| S83 | END OF DATA? |
| S84 | ASSIGN NEXT SEARCH START ADDRESS TO FIRST POINTER |
| S85 | "▿" DATA? |
| S86 | SET CODE DATA ON LOWER PRINTING LINE TO CORRESPONDING ADDRESSES IN SECOND ARRANGEMENT MEMORY |
| S87 | CONVERT TO SPACES "▿" DATA AND SUBSEQUENT CONTIGUOUS DATA IN FIRST ARRANGEMENT MEMORY |

FIG. 10B

| ITEM | INSTRUCTION |
|---|---|
| S90 | SET ADDRESS TO SECOND POINTER |
| S91 | READ CODE DATA POINTED TO BY FIRST POINTER |
| S92 | STORE DOT PATTERN DATA INTO PRINTING BUFFER |
| S93 | BASE LINE POSITION CHANGE? |
| S94 | READ BASE LINE POSITION CHANGE AMOUNT "d" |
| S95 | $d \leftarrow 0$ |
| S96 | SHIFT DOT PATTERN DATA BY (4+d) DOTS |
| S97 | READ CODE DATA POINTED TO BY SECOND POINTER |
| S98 | STORE DOT PATTERN DATA IN PRINTING BUFFER |
| S99 | BASE LINE POSITION CHANGE? |
| S100 | READ BASE LINE POSITION CHANGE AMOUNT "d" |
| S101 | $d \leftarrow 0$ |
| S102 | SHIFT DOT PATTERN DATA BY (4+d) DOTS |

TAPE PRINTING DEVICE FOR PRINTING A PLURALITY OF PRINTING LINES ACROSS THE WIDTH OF A TAPE

CROSS-REFERENCE TO RELATED APPLICATION AND PATENT

U.S. Pat. No. 4,927,278 is expressly incorporated by reference in its entirety herein. This application is also related to U.S. patent application No. 07/831,996, entitled "TAPE PRINTER HAVING SPACING FUNCTION", filed concurrently herewith, the disclosure of which is incorporated herein by reference.

BACKGROUND OF THE INVENTION

1. Field of the Invention

The present invention relates to a tape printing device, and more particularly, to a tape printing device that can print characters in each of a plurality of printing lines which are made by dividing the printing area across the width of the printing medium tape.

2. Description of Related Art

Heretofore, a number of proposals have been made regarding improvements in small-size tape printers that print desired character strings along a printing tape which is, for example, about 10 mm wide. A tape printer proposed by the applicant of the present application, and disclosed in Japanese Laid-Open Patent No. 1-152070 is capable of printing full size and double size characters, and of selectively printing full size characters either in center printing mode or in lower-side printing mode. In center printing mode, the tape printer prints full size characters at the center of the tape (across its width); in lower-side printing mode, the tape printer prints the characters on the lower-side of the tape (across its width).

In many instances, for example, the tape printer is used to print a title, or information regarding the contents of a given file, onto a printing tape, the printed tape being adhered (pasted) onto an appropriate position of a casing of the file.

However, this conventional printing device is only capable of changing printing position between the center printing mode, wherein characters are printed at the center of the printing tape, and the lower printing mode, wherein characters are printed on the lower side of the printing tape. Therefore, the number of characters which can be printed within a certain predefined length of the tape (the length of the tape is usually defined and limited by the size of a particular pasting position on the file) is restricted to the number of characters which can be printed across the predefined length of the tape. (That is, the total number of characters which can be printed equals the tape length divided by the character width.) Thus the number of characters which can be printed on a length of tape is a function of the pasting position size and the width of characters.

Even if the printing device is capable of printing in an upper printing mode, wherein characters are printed on the upper side of the printing tape, the same problem exists because characters printed in the upper printing mode and characters printed in the lower printing mode are not printed so that characters of the lower line are printed directly below characters of the upper line.

SUMMARY OF THE INVENTION

It is therefore an object of the present invention to provide a tape printing device capable of receiving characters (input characters) and printing the characters on a plurality of printing lines which are defined by dividing the printing area of the printing medium tape across its width, the input characters being printed in a plurality of desired printing lines so that characters of the lower line are located directly below characters of the upper line, thereby permitting the printing of many more characters along a predefined length of tape than was previously possible.

To achieve the foregoing and other objects, and to overcome the shortcomings discussed above, according to one aspect of the present invention, there is provided a tape printer for printing characters onto a print medium tape in accordance with input data, the tape printer comprising: input means for inputting the code data for characters, and for various command signals; an input data buffer for storing the input code data; pattern data storing means for storing the dot pattern data for all characters capable of being printed; a printing buffer for receiving and storing the dot pattern data of characters to be printed; a printing head for printing dot strings (columns of dots) onto a print medium tape on which characters are printed; controlling means for controlling the printing head by successively receiving dot strings for a dot pattern from the printing buffer; printing setting means for setting (selecting) at least one of a plurality of printing lines defined by dividing a printing area on a print medium tape across the tape width in accordance with input code data; data arrangement means for receiving the code data from the input data buffer and an output from the printing setting means, for arranging the code data received by the input data buffer so as to enable the printing of a plurality of printing lines of characters directly adjacent to each other across the tape width, and for storing the arranged code data; and data revising means for receiving the dot pattern data corresponding to the input character code data from the pattern data storing means, and for revising the dot strings for a dot pattern corresponding to the arranged characters for printing a plurality of printing lines of characters directly adjacent to each other across the tape width.

In a preferred structure according to the invention, when code data input by an input means are stored in the input data buffer, at least one of a plurality of printing lines made by dividing a printing area on a printing medium tape (the printing area corresponds to the tape width) is set (selected) in accordance with input code data. The data arrangement means receives the code data output by the input data buffer, and code data output by the printing setting means, and arranges the input code data, and then stores the arranged code data so that the characters can be printed in a plurality of lines directly adjacent to each other across the tape width. Data revising means receives dot pattern data corresponding to the input character code data from a pattern data memory means based on the code data arranged by the data arrangement means, and revises a dot pattern data group (comprising a plurality of dot strings) corresponding to the characters as arranged so that the characters for a plurality of printing lines, located adjacent to each other across the tape width, can be printed. The data revising (composing) means then sends the pattern data group to a printing buffer. As a result of this process, the control means receives the revised dot pattern data (pattern data groups) from the printing buffer as successive dot lines, and controls the printing head, so that each character from a plurality of printing lines, adjacent to each other across the tape width is printed in its set printing line on the printing medium tape. Accordingly, characters located in adjacent printing lines can be printed.

With this structure, printing setting means, data arrangement means and data revising means are added to existing tape printer structure. When code data from the input data buffer are arranged, the dot pattern data of the arranged characters are revised and stored in the printing buffer. Since characters are printed on the printing medium tape based on these revised dot pattern data, input characters from different printing lines can be printed adjacent to each other in their respective printing lines on the printing medium tape so that, for example, characters of a lower line are located directly below characters of an upper line. Therefore, more characters can be printed over a plurality of printing lines on a tape than was previously possible.

BRIEF DESCRIPTION OF THE DRAWINGS

The invention will be described in detail with reference to the following drawings in which like reference numerals refer to like elements, and wherein:

FIGS. 5A and 5B are a partial flowchart and table outlining a tape printing control routine for use with the first embodiment of the present invention;

FIGS. 6A and 6B are another partial flowchart and table outlining the tape printing control routine;

FIGS. 7A and 7B are another partial flowchart and table outlining the tape printing control routine;

FIGS. 8A and 8B are a flowchart and table outlining a printing process control routine used in the present invention;

FIGS. 9A and 9B are a flowchart and table outlining an arranging process control routine for use in the present invention;

FIGS. 10A and 10B are a flowchart and table outlining a data revising process control routine for use in the present invention;

DETAILED DESCRIPTION OF THE PREFERRED EMBODIMENTS

Preferred embodiments of the invention will now be described with reference to the accompanying drawings. The first embodiment utilizes a tape printer capable of printing numerous kanji characters, hiragana characters, katakana characters and alphabetic characters onto a printing tape (also referred to as a print medium tape).

Figure 1:
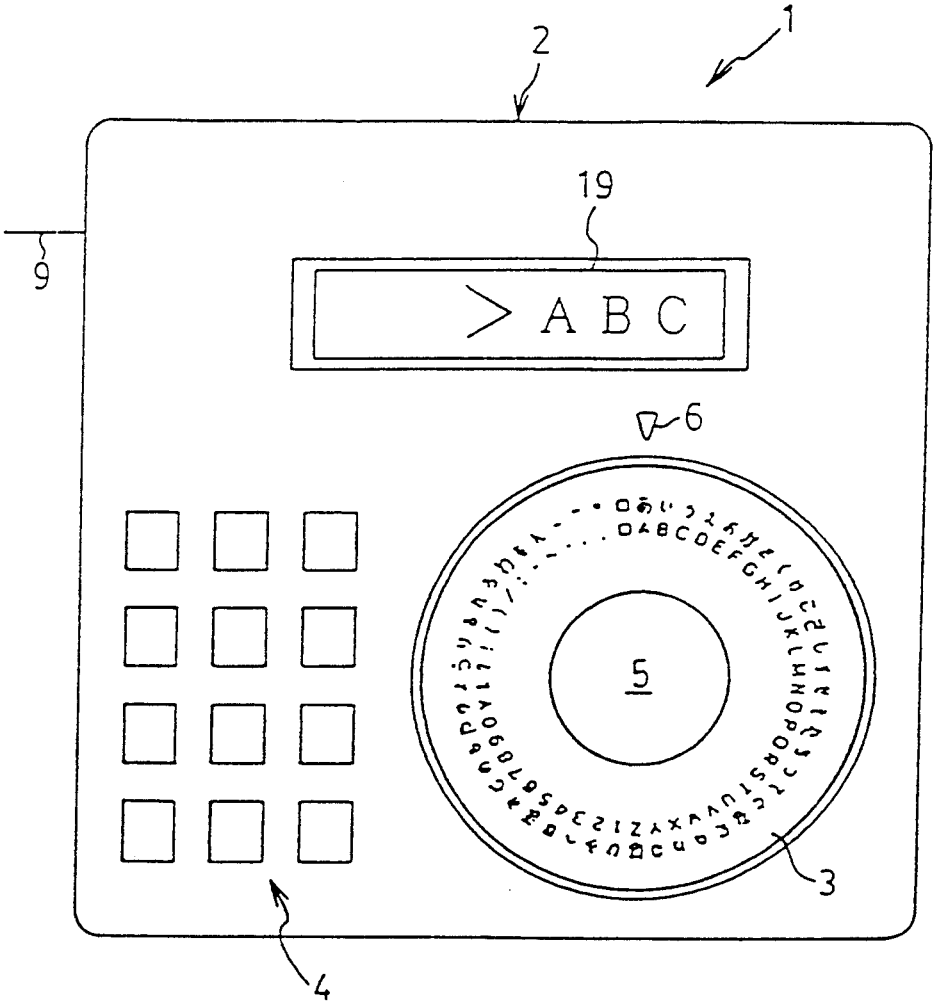
FIG. 1 is a plan view of a tape printer in which a first embodiment of the present invention can be practiced.

As shown in FIG. 1, at the front end of a body frame 2 of the tape printer 1 is a rotatably positioned round-shaped character selecting dial 3 for selecting characters (including symbols). Also positioned at the front end of the body frame 2 is a keyboard 4. Behind the character selecting dial 3 is an LCD 19 capable of displaying, for example, up to six characters. At the center of the character selecting dial 3 is a setting key 5 for setting (entering) the characters selected by rotation of the character selecting dial 3, or for establishing (entering) printing-related settings. Furthermore, a printing mechanism PM (see FIG. 2) is incorporated within the body frame 2 at the rear of the character selecting dial 3.

The character selecting dial 3 has, for example, 50 stop positions per revolution. Inscribed on top of the dial 3 are the images of the selectable characters in two concentric circles, two characters corresponding to each of the 50 stop positions. Reference numeral 6 indicates a character selecting position mark.

The keyboard 4 comprises a character type change-over key for alternately selecting the hiragana, katakana or alphabetic character type; a converting key (for converting hiragana characters to kanji characters); a non-converting key; a double-line printing key for causing characters to be printed in two lines; a single-line printing key for causing characters to be printed in one line; a printing key for executing printing; a font selecting key for selecting a desired character font; a tape feed key for feeding the printing tape 9, and a power switch for turning the power ON and OFF.

Figure 2:
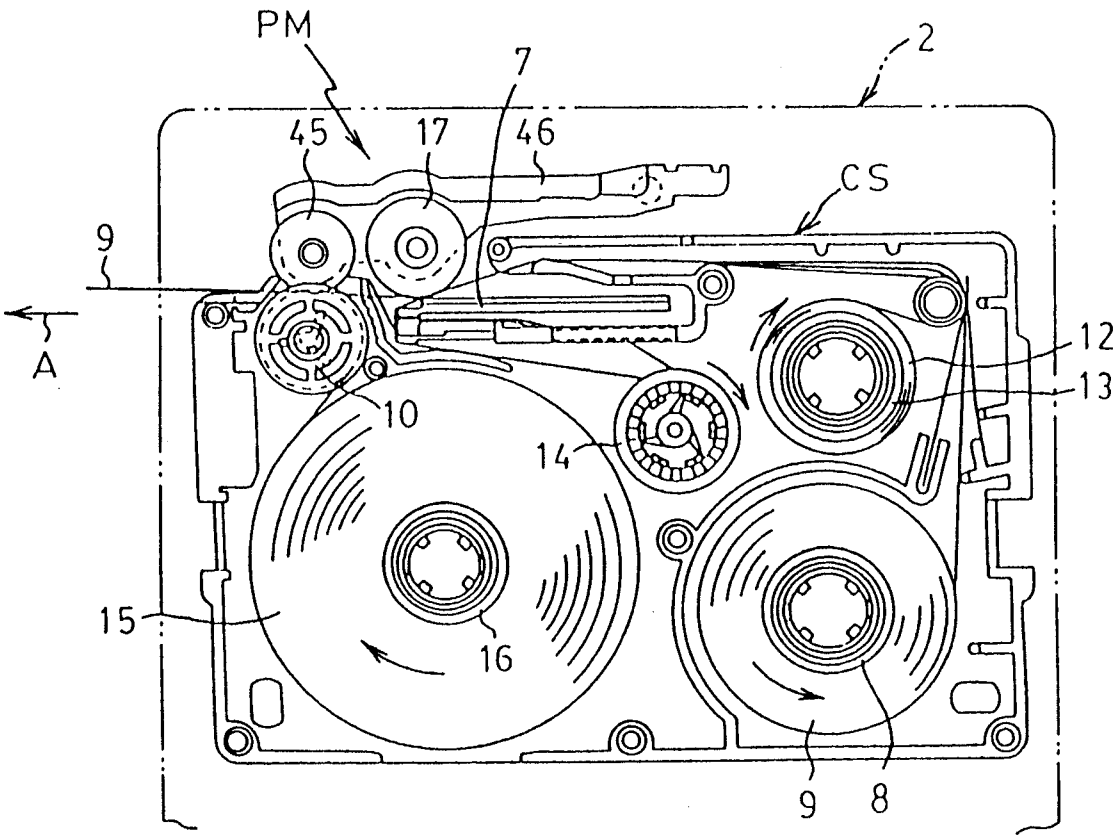
FIG. 2 is a schematic plan of a printing mechanism in the FIG. 1 tape printer.

Referring to FIG. 2, the printing mechanism PM will now be briefly described. A rectangular tape cassette CS contains a tape spool 8 around which the printing tape 9, made of a transparent film, is wound; a ribbon feed spool 13 around which an ink ribbon 12 is wound; a take-up spool 14 for taking up (receiving) the used ink ribbon 12; a feed spool 16 around which a double-sided adhesive tape 15 having the same width as the printing tape 9 is wound with its releasable sheet facing outwardly; and a bonding roller 10 for bonding the printing tape 9 and the double-side adhesive tape 15 together, the roller 10 and spools 8, 13, 16 all being rotatably furnished in cassette CS.

Figure 4:
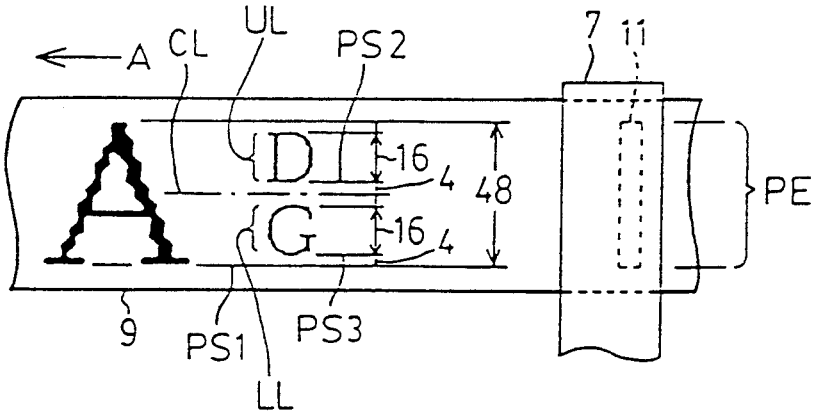
FIG. 4 is a partial front view of the printing mechanism having a thermal head, which extends across substantially the entire width of a printing tape, positioned adjacent to the printing tape.

The thermal head 7 is located at a position where the printing tape 9 and the ink ribbon 12 overlap each other. A platen roller 17 presses the printing tape 9 and the ink ribbon 12 against the thermal head 7. A feed roller 45 presses the printing tape 9 (which now contains printed characters) and double-sided adhesive tape 15 against the bonding roller 10. The platen roller 17 and the feed roller 45 are rotatably supported by a support member 46. The thermal head 7 has a heating element assembly 11 comprised of, for example, 48 heating elements arranged vertically to extend across the tape width, as shown in FIG. 4.

In operation, the bonding roller 10 and the take-up spool 14 are driven in synchronism in their respective directions by a tape feed motor 18 (FIG. 3) while the heating element assembly 11 is being powered to form characters on printing tape 9. This causes a plurality of dot columns (dot strings) to be printed on the printing tape 9 to form characters thereon, as depicted in FIG. 4. The printing tape 9 with the double-sided adhesive tape 15 adhered thereto is fed in the direction of arrow A and out of the body frame 2. For a more detailed description of the printing mechanism, see the above-incorporated U.S. Pat. No. 4,927,278.

Figure 3:
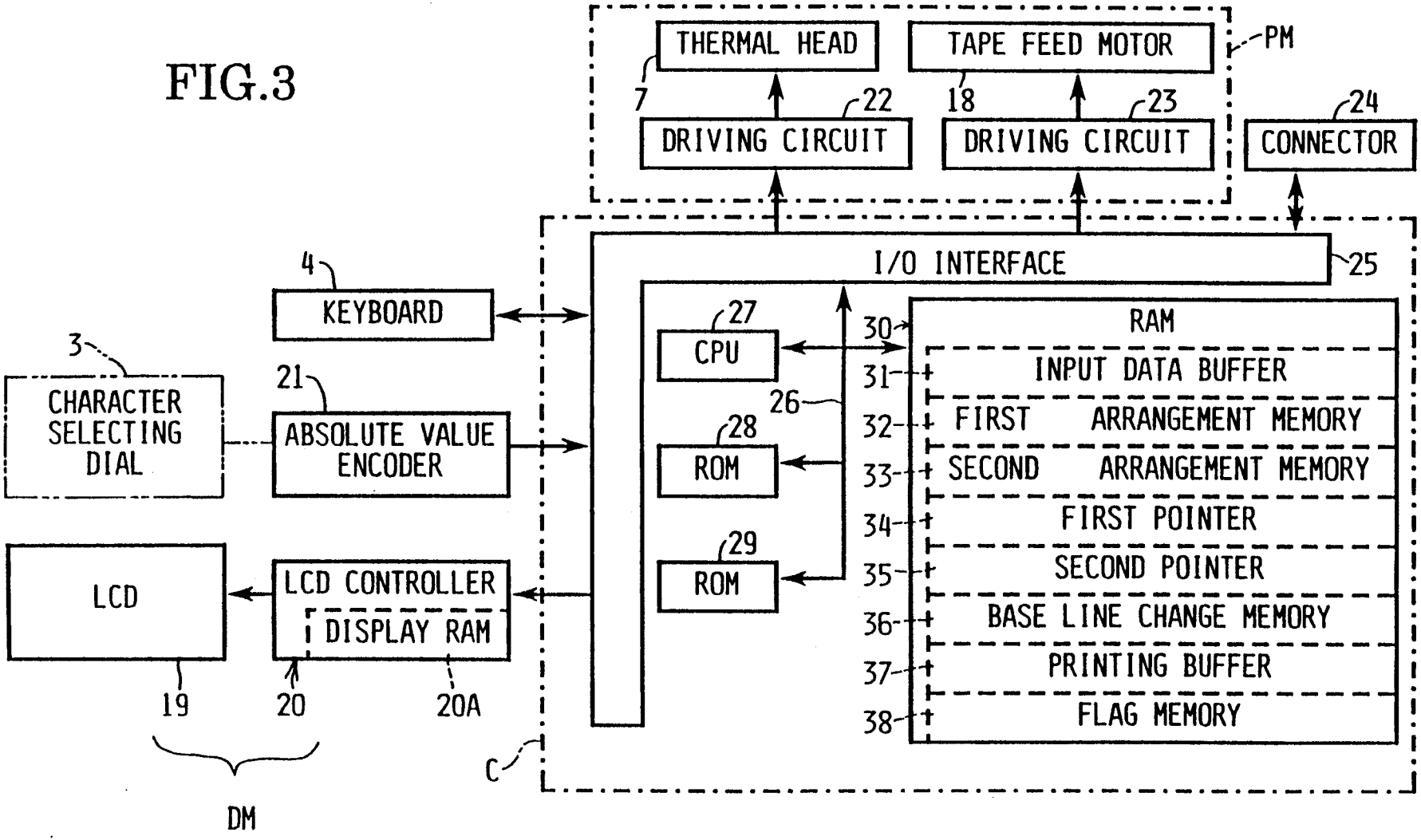
FIG. 3 is a block diagram of a control system for use with the FIG. 1 tape printer in which the first embodiment of the present invention is practiced.

The control system of the tape printer 1 is constructed as shown in FIG. 3. Display mechanism DM is a conventional arrangement comprising the LCD 19 and an LCD controller 20. The LCD controller 20 includes a display RAM 20A for outputting display data to the LCD 19. An absolute value encoder 21, connected to the character selecting dial 3, outputs 50 absolute value encoder signals ENS corresponding to the 50 stop positions of the dial 3. Each of the absolute value encoder signals ENS and a signal from the font selecting key (provided on keyboard 4) allow the code data regarding a character at the character selecting position mark 6 to be obtained when setting key 5 is pressed. Comparing the absolute value encoder signal ENS in effect before the selecting operation with the current absolute value encoder signal ENS (that is, the ENS output when the selecting operation is performed) provides the rotating direction of the character selecting dial 3, and the amount of its rotation. A driving circuit 22 drives the thermal head 7, and a driving circuit 23 drives the tape feed motor 18.

A controller C comprises a CPU 27, an I/O interface 25 connected to the CPU 27 via a bus 26 (e.g., a data bus), ROM's 28 and 29, and a RAM 30. The ROM 28 (a program memory) contains a display control program, a data storage control program, a driving control program and a tape printing control program. The display control program controls the display mechanism DM in accordance with the code data selected by the character selecting dial 3, and command data provided by selecting the keys on keyboard 4. The data storage control program stores into an input data buffer 31 the character code data defined by operation of the setting key 5 as well as various types of set command data (for example, font, single-line printing, double-line printing, etc.) about printing-related settings. The driving control program controls the driving of the thermal head 7 and the tape feed motor 18 by successively reading data (for example, one data column at a time) from a printing buffer 37. The tape printing control program will be described later in more detail.

The ROM 29 (a pattern data memory) contains two different types of dot pattern data for each of the numerous characters inscribed on the character selecting dial 3. One data type is SS character pattern data comprising matrix data having a size of 16 dots (high) by 15 dots (across); the other data type is L character pattern data comprising matrix data having a size of 48 dots (high) by 48 dots (across). The SS character pattern data are used to display characters on display 19, and to print two lines of characters, while the L character pattern data are used to print a single line of characters. A connector 24 may be attached to an optional ROM card containing dot pattern data for various fonts.

The input data buffer (RAM) 31 contains the code data for characters to be printed (i.e., characters selected with dial 3 and setting key 5) as well as various types of set command data regarding printing-related settings. (See, for example, FIG. 11: "A" in a notation "A0000" indicates that this is an address which applies to the input data buffer 31, and which begins at location "A0000". A first arrangement memory 32 stores the character code data for single-line printing and the upper-line character code data for double-line printing. (See, for example, FIG. 12: "a" in a notation "a0000" indicates that this is an address which applies to the first arrangement memory 32, and which begins at location "a0000".) A second arrangement memory 33 contains the lower-line character code data for double-line printing. (See, for example, FIG. 12: "b" in a notation "b0000" indicates that this is an address which applies to the second arrangement memory 33, and which begins at location "b0000"). A first pointer 34 stores one of the addresses in the first arrangement memory 32, and a second pointer 35 stores one of the addresses in the second arrangement memory 33. In the present specification, all numbers representing addresses are represented in hexadecimal notation.

Figure 16:
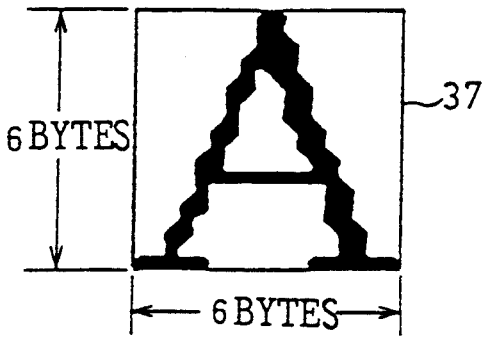
FIG. 16 is a view schematically depicting dot pattern data for a double-size character in a printing buffer.

A base line change memory 36 accommodates the change amount of the printing base line position (across the tape width) compared to the normal (default) printing base lines PS2 and PS3 (see FIG. 4). The printing buffer 37, as illustrated in FIG. 16, has a capacity large enough to accommodate 48 dots in height (i.e., in a dot column direction; also referred to as a string of dots) corresponding to 48 bits (6 bytes) of information, and 48 dots in width corresponding to 48 bits (6 bytes) of information. The dot pattern data of each character to be printed are read sequentially from the pattern data memory 29 and temporarily stored into the printing buffer 37 prior to printing each character (this will be described in more detail below). The contents of the printing buffer 37 is referred to as a dot pattern group (48 dot strings, each dot string being 48 bits (dots) long). A flag memory 38 accommodates the data for various flags. These flags include a double-line printing flag F1 that is set (to "1") when double-line printing is selected; an upper-line printing flag F2 set (to "1") when upper-line (i.e., first line) printing is selected in double-line printing mode; a base line position display flag F3 set (to "1") when a setting for changing the printing base line position is displayed; a base line position change flag F4 set (to "1") when the printing base line position is changed (i.e., when a displayed base line position is changed from a default position); a display flag F5 set (to "1") when a setting for changing the printing base line position is displayed; and a font flag. In the remaining description, the terminology "flag is set" means the flag is set to "1"; "the flag is reset" means the flag is set to "0".

A description is now provided of the manner in which a tape printing control routine is executed by the controller C of the tape printer 1, with reference to the flowcharts of FIGS. 5A through 10A. In the figures, Si (i=1, 2, 3, ...) indicates a step. As shown in FIG. 4, characters can be printed in two ways using the described tape printing control routine. During single-line printing, characters are printed in a single line across the entire printing area PE, as illustrated by the character "A", on the printing tape 9. The printing area PE corresponds to the length of the heating element assembly 11 of the thermal head 7, and in the illustrated embodiment extends across almost the entire width of tape 9. (Although the illustrated heating element assembly 11 extends across the entire tape width, it is also possible to use a shorter heating element assembly that requires multiple passes along the tape length to print across the entire tape width.) When performing the single-line printing, the printing is performed on the basis of L character pattern data. During double-line printing, the upper-line characters are printed along the upper printing line UL of the printing area PE, while the lower-line characters are printed along the lower printing line LL of the area PE. (If a shorter heating element assembly 11 were used, it could print the upper line UL on one pass, and the lower line LL on a second pass.) When performing double-line printing, the printing is performed in accordance with SS character pattern data. The normal printing base line PS1 for L characters is positioned at the bottom of the heating element assembly 11. The printing base line PS2 for SS characters on the upper line is positioned 4 dots above the center line CL which bisects the heating element assembly 11. The normal printing base line PS3 for SS characters on the lower line is positioned 4 dots above the printing base line PS1. The numbers 4, 16 and 48 in FIG. 4 indicate numbers of dots.

Figure 6A:
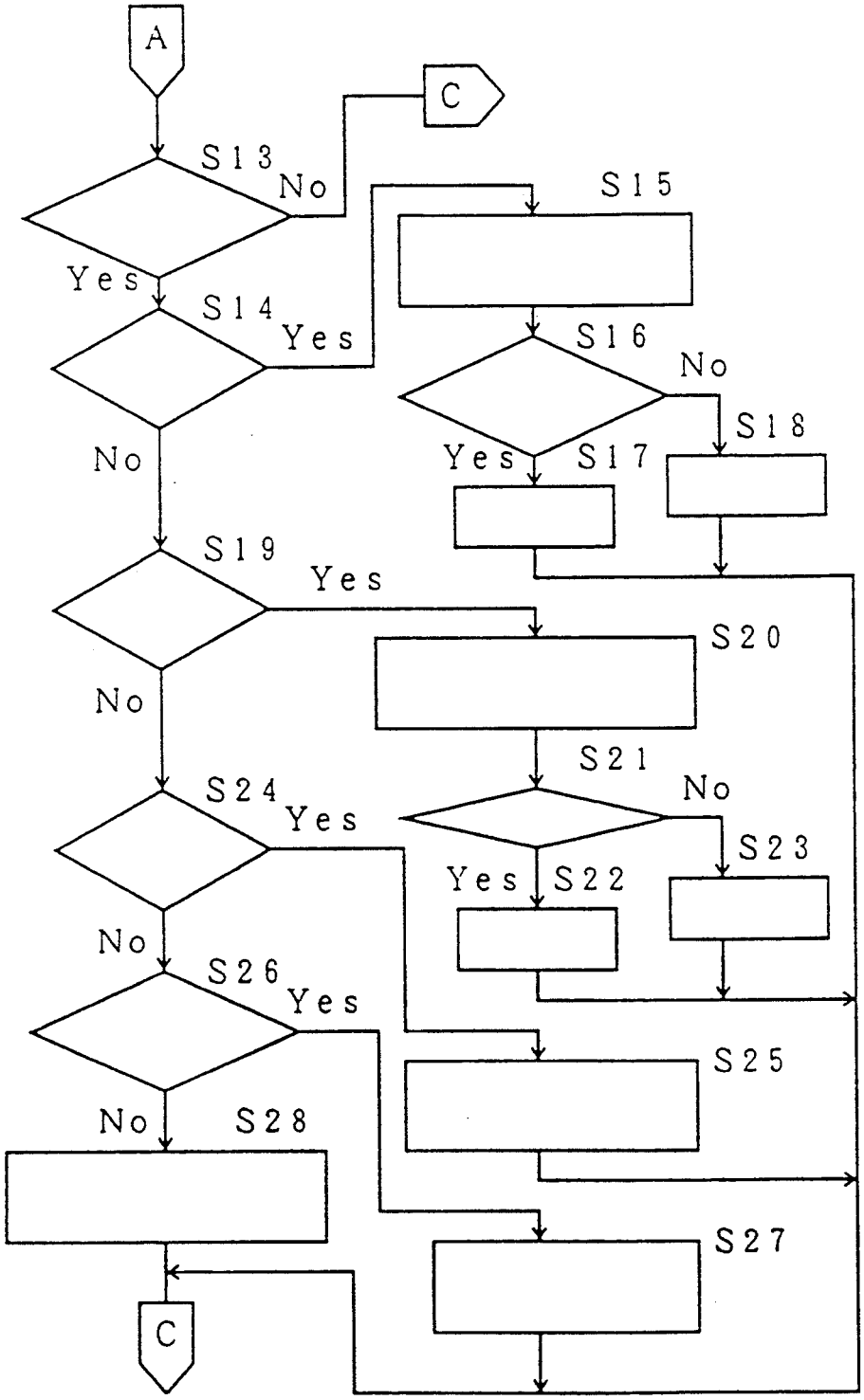

Applying power to the tape printer 1 starts execution of the tape printing control routine. Step S1 establishes initial settings which include clearing the display mechanism DM and the memories 31 through 38, displaying a single-line printing mark (>) on the LCD 19, and storing single-line printing command data to the start address in the input data buffer 31. When the character selecting dial 3 is rotated, step S1 is succeeded by step S2. In step S2, a check is made to determine whether any key input (i.e., setting key 5, the double-line printing key, the single-line printing key, the print key, etc.) is made. If there is no key input, flow proceeds to step S13 (FIG. 6A). In steps S13, S14, S19, S24 and S26, determinations are made as to whether any of the flags F1, F3, F5,... are set by determining (in S13) whether there has been a change in the ENS (i.e., whether dial 3 has been rotated). If dial 3 was not rotated, the value of ENS does not change, and therefore flow returns to S2. Thus, steps S2 and S13 are repeated until one of their results is YES. If dial 3 was rotated (the YES output of S13), flow proceeds to S14. Since initially none of the flags is set, step S13 is followed by steps S14, S19, S24, S26 and S28, in that order. Step S28 displays on the LCD 19 the character identified according to the encoder signal ENS from the absolute value encoder 21 (the character adjacent to mark 6). Step S28 is succeeded by step S2.

Figure 7A:
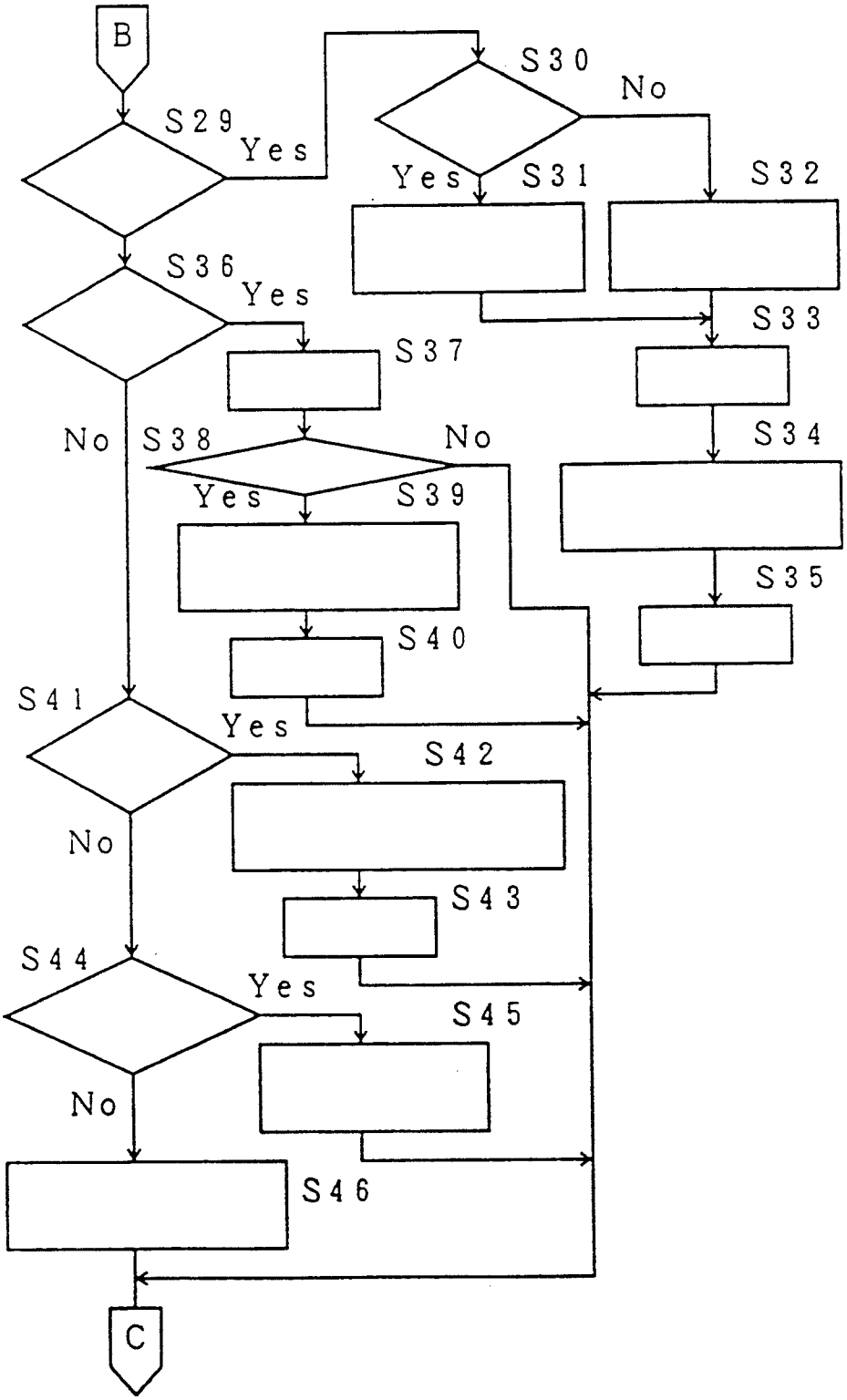
Figure 11:
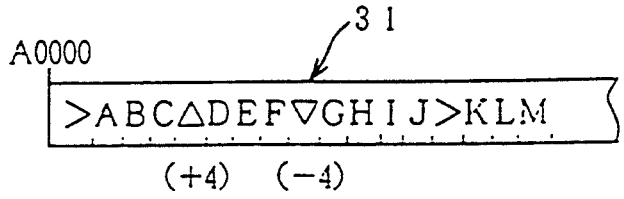
FIG. 11 is a view schematically depicting illustrative data in an input data buffer for the first embodiment of the invention.

If a determination is made that a key was operated in S2, flow proceeds to S3. If the setting key 5 is actuated, step S2 is followed by steps S3 and S29 (FIG. 7A). If none of the flags F1, F3 or F5 is found to be set, step S29 is followed by steps S36, S41, S44 and S46, in that order. Thus, when step S46 is reached, the operator desired to select the character displayed on LCD 19. Accordingly, step S46 selects the character currently displayed on the LCD 19 and stores the code data thereof to the input data buffer 31 For example, if the setting key 5 is operated to display characters "A", "B" and "C" on the LCD 19, the LCD 19 displays the indication shown in FIG. 1. In this case, the code data about the characters "A", "B" and "C" are stored successively into the input data buffer 31 as shown in FIG. 11.

If, however, the double-line printing key is operated to execute double-line printing, step S2 is followed by steps S3, S4 and S5, in that order. Step S5 displays the first selected setting for double-line printing (e.g., an indication "UPPER PRINTING LINE") on the LCD 19. Step S5 is followed by step S6 in which the flag F1 is set. When the character selecting dial 3 is rotated next, step S2 is followed by steps S13 and S14. Since the flag F1 is set, step S14 is followed by step S15 in which the LCD 19 displays a different selected setting for double-line printing (e.g., an indication "LOWER PRINTING LINE"). In step S16, a check is made to determine whether the LCD 19 has the "UPPER PRINTING LINE" indication. If the LCD 19 is providing the "UPPER PRINTING LINE" indication, step S17 is reached in which the flag F2 is set. If the LCD 19 is giving the "LOWER PRINTING LINE" indication, step S18 is reached in which the flag F2 is reset. Thus, after selecting the double-line printing key, LCD 19 displays "UPPER PRINTING LINE" or "LOWER PRINTING LINE". The operator changes the display by rotating dial 3, and flag F2 is set or reset accordingly.

When the setting key 5 is operated next, step S2 is followed by steps S3 and S29 (FIG. 7A). If the two flags F1 and F2 are found to be set in steps S29 and S30, step S31 is reached. Step S31 displays an upper printing line mark "Δ" on the LCD 19 and stores into the input data buffer 31 the upper line printing command data corresponding to that mark. If the flag F2 is found to be reset in step S30, step S32 is reached. Step S32 displays a lower printing line mark "∇" on the LCD 19 and stores into the input data buffer 31 the lower line printing command data corresponding to that mark. Thus, if the setting key 5 is operated while the LCD 19 is giving the "UPPER PRINTING LINE" indication, the upper printing line mark "Δ" appears on the LCD 19 and the upper line printing command data are set to an address A0004 in the input data buffer 31 (see FIG. 11).

In step S33, the flag F1 is reset. In step S34, the LCD 19 displays the selected setting regarding the change in the printing base line position, e.g., an indication "NORMAL BASE LINE POSITION" which means that the printing base line position remains unchanged relative to the normal printing base lines PS2 and PS3. In step S35, the flag F3 is set.

Figure 5A:
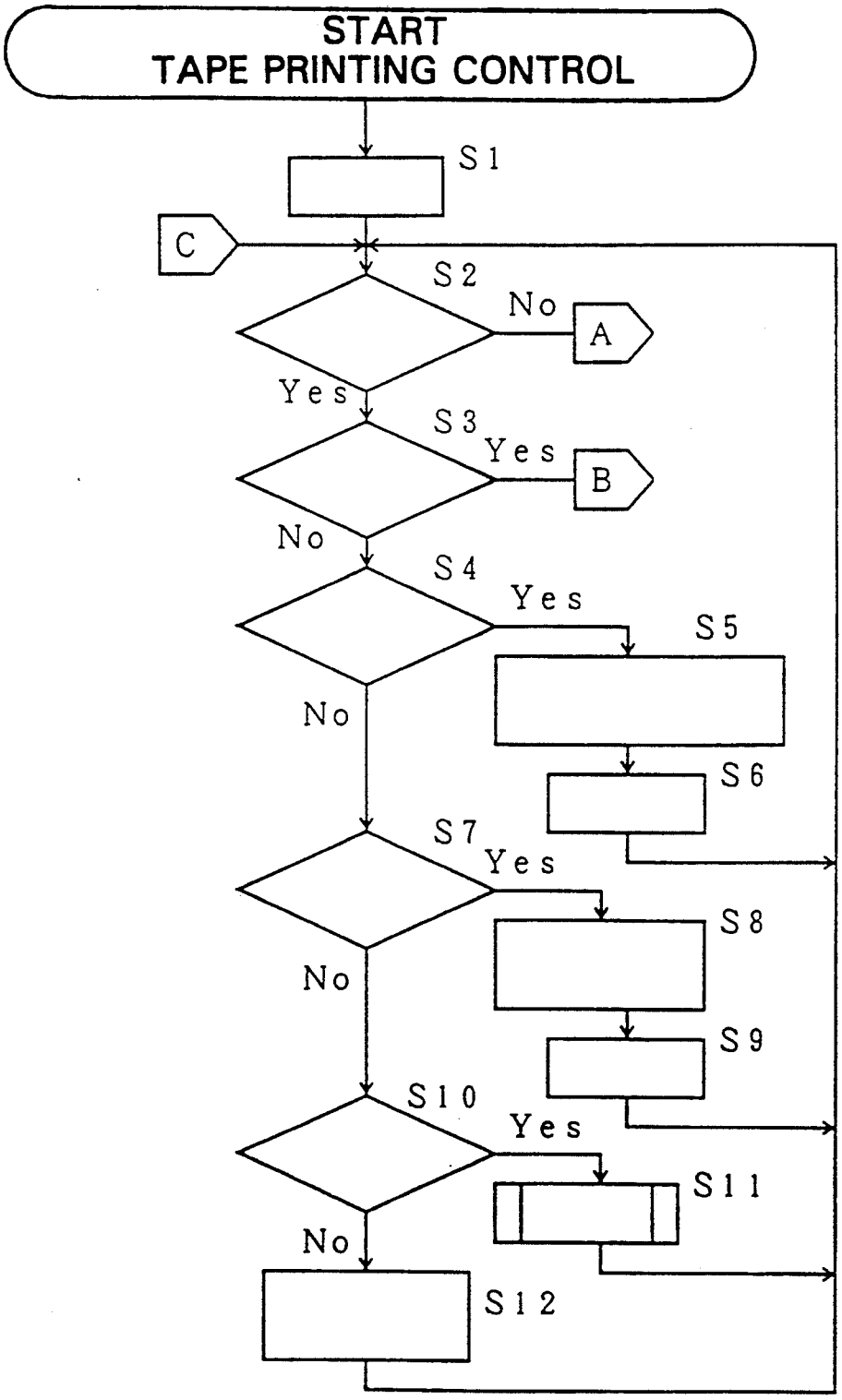

With reference to FIGS. 5A and 6A, when the character selecting dial 3 is rotated next, step S2 is followed by steps S13, S14 and S19. Since the flag F3 is found to be set in step S19, step S20 is reached. In step S20, the LCD 19 displays the next selected setting regarding the change in the printing base line position, e.g., an indication "BASE LINE POSITION CHANGED" which means that the printing base line position is changed. If the LCD 19 is found to have the "BASE LINE POSITION CHANGED" indication in step S21, step S22 is reached in which the flag F4 is set. If the LCD 19 is found to have the "NORMAL BASE LINE POSITION" indication in step S21, step S23 is reached in which the flag F4 is reset. Thus, once the "NORMAL BASE LINE POSITION" indication is provided on LCD 19, the operator rotates dial 3 if they desire to change the base line position, and then presses the setting key 5; otherwise, the setting key 5 is pressed without rotating dial 3 when no base line position change is desired.

Referring to FIGS. 5A and 7A, when the setting key 5 is operated next, step S2 is followed by steps S3, S29 and S36, in that order. If the flag F3 is found to be set in step S36, step S37 is reached in which the flag F3 is reset. In step S38, if the flag F4 is found to be set (i.e., it is desired to change the base line position), step S39 is reached. In step S39, the LCD 19 displays the first selected setting for the printing base line position change, e.g., an indication "BASE LINE POSITION +4" which means that the printing base line is positioned 4 dots above the normal printing base lines PS2 and PS3 on the printing tape 9. In step S40, the flag F5 is set.

With reference to FIGS. 5A and 6A, when the character selecting dial 3 is rotated next, step S2 is followed by steps S13, S14, S19 and S24, in that order. Since the flag F5 is found to be set in step S24, step S25 is reached. In step S25, the LCD 19 displays the next selected setting regarding the printing base line position, e.g., an indication "BASE LINE POSITION +3". Thereafter, if the character selecting dial 3 is rotated continuously, the LCD 19 displays successively the selected settings: "BASE LINE POSITION +2"; "BASE LINE POSITION +1"; "BASE LINE POSITION−1"; "BASE LINE POSITION−2"; "BASE LINE POSITION−3"; "BASE LINE POSITION−4"; "BASE LINE POSITION +4"; and so on. Each of the "BASE LINE POSITION−1" to "BASE LINE POSITION−4" indications means that a shift of the printing base line position toward the lower edge of the printing tape 9 relative to the normal printing base lines PS2 and PS3 can be entered. The above control operations are carried out according to the absolute value encoder signals ENS that are output by the absolute value encoder 21.

With reference to FIGS. 5A and 7A, when the setting key 5 is operated next, step S2 is followed by steps S3, S29, S36 and S41, in that order. Since the flag F5 is found to be set in step S41, step S42 is reached. Step S42 includes into the upper or lower line printing command data the printing base line position change amount data (for example, "BASE LINE POSITION−4", "BASE LINE POSITION+2", etc.) corresponding to the selected setting displayed on the LCD 19. In step S43, the flag F5 is reset.

For example, assume that the setting key 5 is operated when the LCD 19 displays the selected setting "BASE LINE POSITION+4". In that case, as shown in FIG. 11, the change amount data "+4 dots" are included into the upper line printing command data at address A0004. Then, the code data about subsequently selected characters "D", "E" and "F", the lower line printing command data containing the change amount data "−4 dots", and the code data for characters "G", "H", "I" and "J" which are later selected, are successively stored into the input data buffer 31.

With reference to FIG. 5A, when the single-line printing key is operated for single-line printing, step S2 is followed by steps S3, S4, S7 and S8, in that order. In step S8, the LCD 19 displays the single-line printing mark (>) and the single-line printing command data are stored into the input data buffer 31. In step S9, the flag F1 is reset. For example, as depicted in FIG. 11, the input data buffer 31 accommodates the single-line printing command data at address A000D followed by the code data about subsequently selected characters "K", "L" and "M" at addresses A000E through A0010, respectively.

With reference to FIGS. 5A and 6A, if flags other than F1, F3, and F5 are found to be set when the character selecting dial 3 is operated, step S2 is followed by steps S13, S14, S19, S24, S26, and S27. In step S27, the LCD 19 displays successively the selected settings about the flags that are found to be set. Such other flags are not a part of the present invention, and thus no further explanation is required. Additionally, when another flag is found to be set when the setting key 5 is operated, step S2 is followed by steps S3, S29, S36, S41, and S44, in that order. With the flag found to be set in step S44, step S45 is reached in which the selected setting corresponding to the flag is established.

Once the desired characters and other information has been stored in memory, referring to FIG. 5A, when the printing key is operated next, step S2 is followed by steps S3, S4, S7, S10, and S11, in that order. Step S11 starts control over the printing process (see FIGS. 8A and 8B). When printing process control is started, step S50 is reached in which various flags and memory contents regarding printing are initialized. Succeeding step S50, step S51 executes arrangement process control (FIG. 9A). Arrangement process control will now be described with reference to FIGS. 9A, and 11 through 15. With this control process started, all code data in the input data buffer 31 are stored into the first arrangement memory 32 in step S70. End data "FF" are added to the end of these code data.

In step S71, the start address a0000 of the first arrangement memory 32 is assigned to a first pointer 34. (Hereafter, the content of the first pointer 34 is referred to as P1, and the first pointer itself is designated in FIGS. 12 and 13 by P1.) In step S72, the data pointed to by the first pointer P1 in the first arrangement memory 32 are read therefrom. If the read-out data is determined to be the single-line printing command data in step S73, step S73 is followed by steps S85, S83 and S84, in that order. Step S84 assigns the next address to the first pointer P1, and step S72 is reached again. If the read data is determined to be character code data in step S73, the above control operations (steps S83 and S84) are again repeated.

Figure 12:
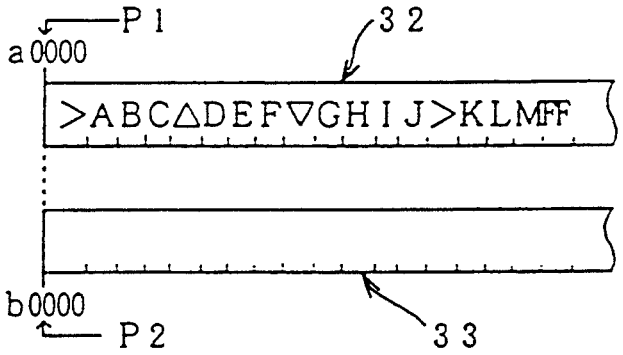
FIG. 12 is a view schematically depicting the data of FIG. 11 in first and second arrangement memories.
Figure 13:
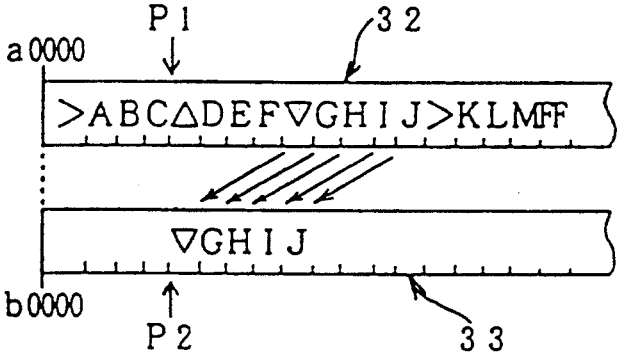
FIG. 13 is a view schematically depicting the data of FIG. 12 in first and second arrangement memories after data for a lower printing line is copied into the second arrangement memory.

In the example of FIGS. 11–13, and as specifically illustrated in FIG. 13, when the first pointer P1 has an address a0004, the data is determined to be the upper-line printing command data in step S73. Then step S73 is followed by step S74 in which the first arrangement memory 32 is searched using the first pointer P1. If it is found, in step S75, that the first arrangement memory 32 contains the lower-line printing command data next to the upper-line printing command data, step S76 is reached. In step S76, as shown in FIG. 13, the address b0004 corresponding to the first pointer P1 is assigned to a second pointer 35. In the illustrated example, since the address of the first pointer in first arrangement memory 32 was a0004, the second pointer receives the address b0004 in the second arrangement memory 33. (Hereafter, the content of the second pointer 35 is referred to as P2, and the second pointer itself is designated in FIGS. 12 and 13 by P2.) Then, the lower-line printing command data and the subsequent code data for the characters to be printed in the lower printing line (LL) are assigned to the addresses following the address of the second pointer P2. When the lower-line printing command data are found in the input data buffer 31 following the upper-line printing command data, printing lines and printing positions are assigned for the lower-line printing command data and the subsequent character code data.

Figure 14:
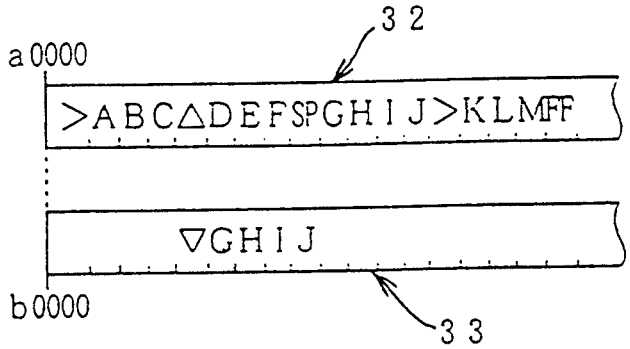
FIG. 14 is a view schematically depicting the data of FIG. 13 in first and second arrangement memories after the lower print line command data in the first arrangement memory is replaced with space data.
Figure 15:
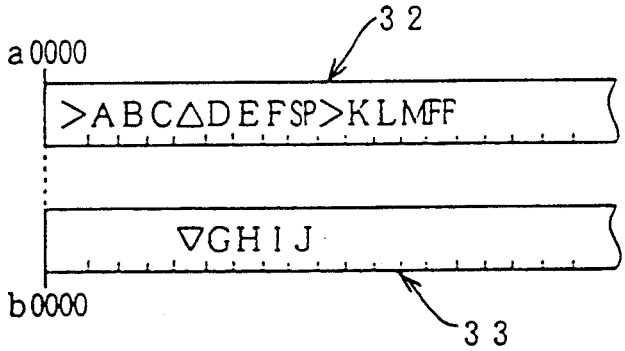
FIG. 15 is a view schematically depicting the data of FIG. 14 in first and second arrangement memories after the lower print line character data is deleted from the first arrangement memory.

In step S78, if the code data count UDN (number of characters to be printed in the upper printing line UL) is found to be smaller than the code data count LDN (number of characters to be printed in the lower printing line LL), step S81 is reached via step S80. In step S81, as illustrated in FIG. 14, a space code SP is assigned to an address a0008 in the first arrangement memory 32 (this is the address which previously contained the lower print line command data). If the code data count UDN is found to be greater than the code data count LDN in step S78, step S79 is reached in which a space code SP is set to an appropriate address in the second arrangement memory 33 (after the last character in the lower print line). Steps S79 and S81 are followed by step S82. If the code data count UDN is equal to the code data count LDN, step S78 is followed by step S82 via step S80. In step S82, the contents of the first arrangement memory 32 are arranged. The arrangements include erasing the data stored into the second arrangement memory 33 and advancing the remaining data such as ">", "K", "L", "M" and "FF", as depicted in FIG. 15 to fill in the addresses vacated by the erased data. If, in step S83, data remains to be searched in the first arrangement memory 32, step S84 is reached in which the next address (b0009 in the present example) is assigned to the first pointer P1. This is the next address to be searched.

For each of the subsequent data ">", "K", "L" and "M", steps S72, S73, S85, S83 and S84 are repeated, in that order. When the end data "FF" are reached in step S83, the control process of FIG. 9A is terminated and control is returned to the flowchart of FIG. 8A (S51).

In FIG. 9A, when the lower line printing command data are not found to exist in step S75, step S77 is reached. In step S77, a space code SP corresponding to the code data count UDN (number of characters printed in the upper printing line UL) is stored into the second arrangement memory 33. If the data read out in accordance with the first pointer Pl are found to be the lower line printing command data in step S73, step S86 is reached via step S85. In step S86, the address in the second arrangement memory 33 corresponding to the first pointer P1 is assigned to the second pointer P2, and the lower line printing command data and the subsequent code data for the characters to be printed in the lower printing line LL are assigned to the addresses following the address of the second pointer P2 in the second arrangement memory 33. In step S87, the lower line printing command data and the code data for the characters to be printed in the lower printing line LL are all converted to space codes in the first arrangement memory.

Figure 8A:
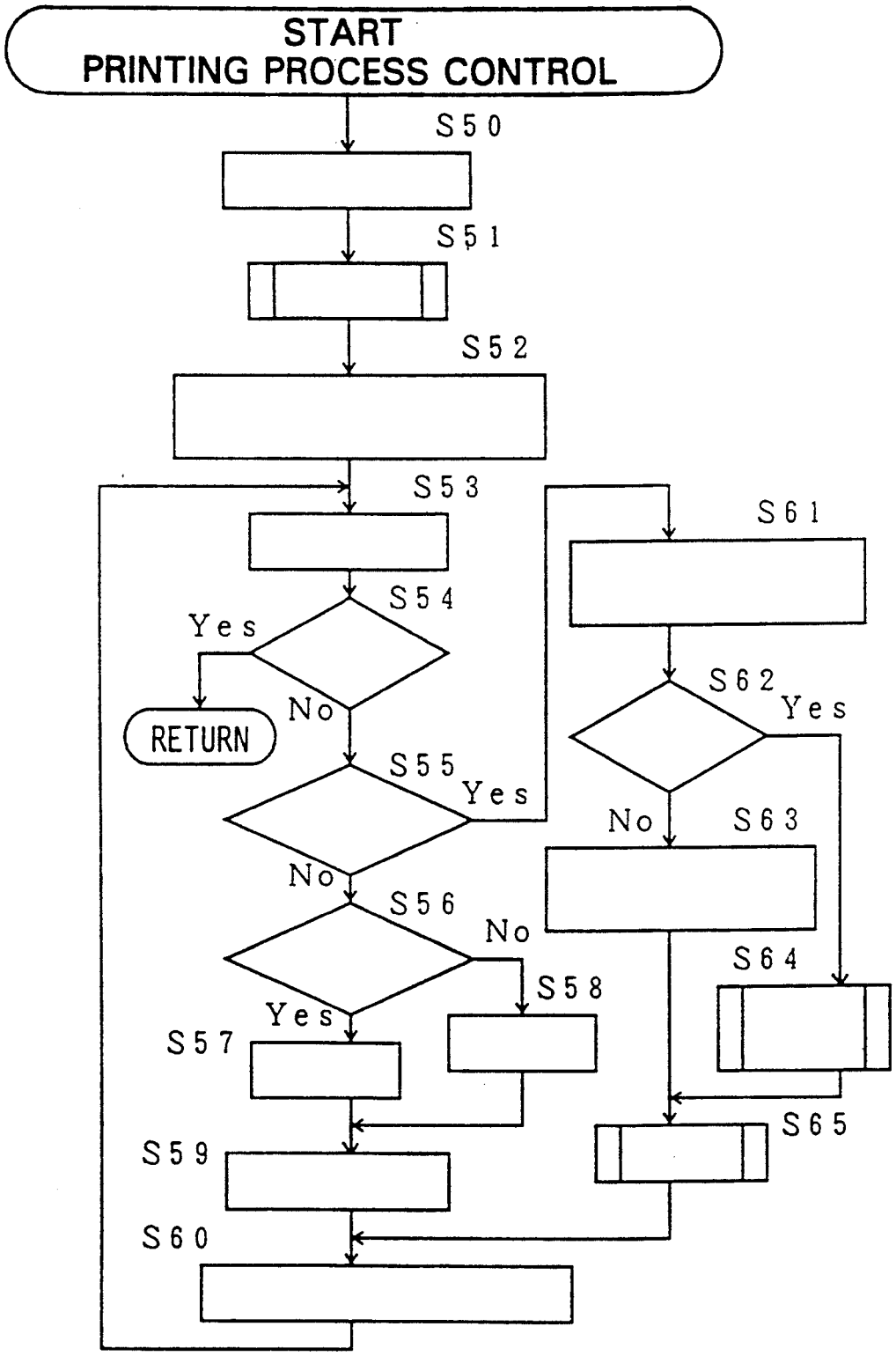
Figure 9A:
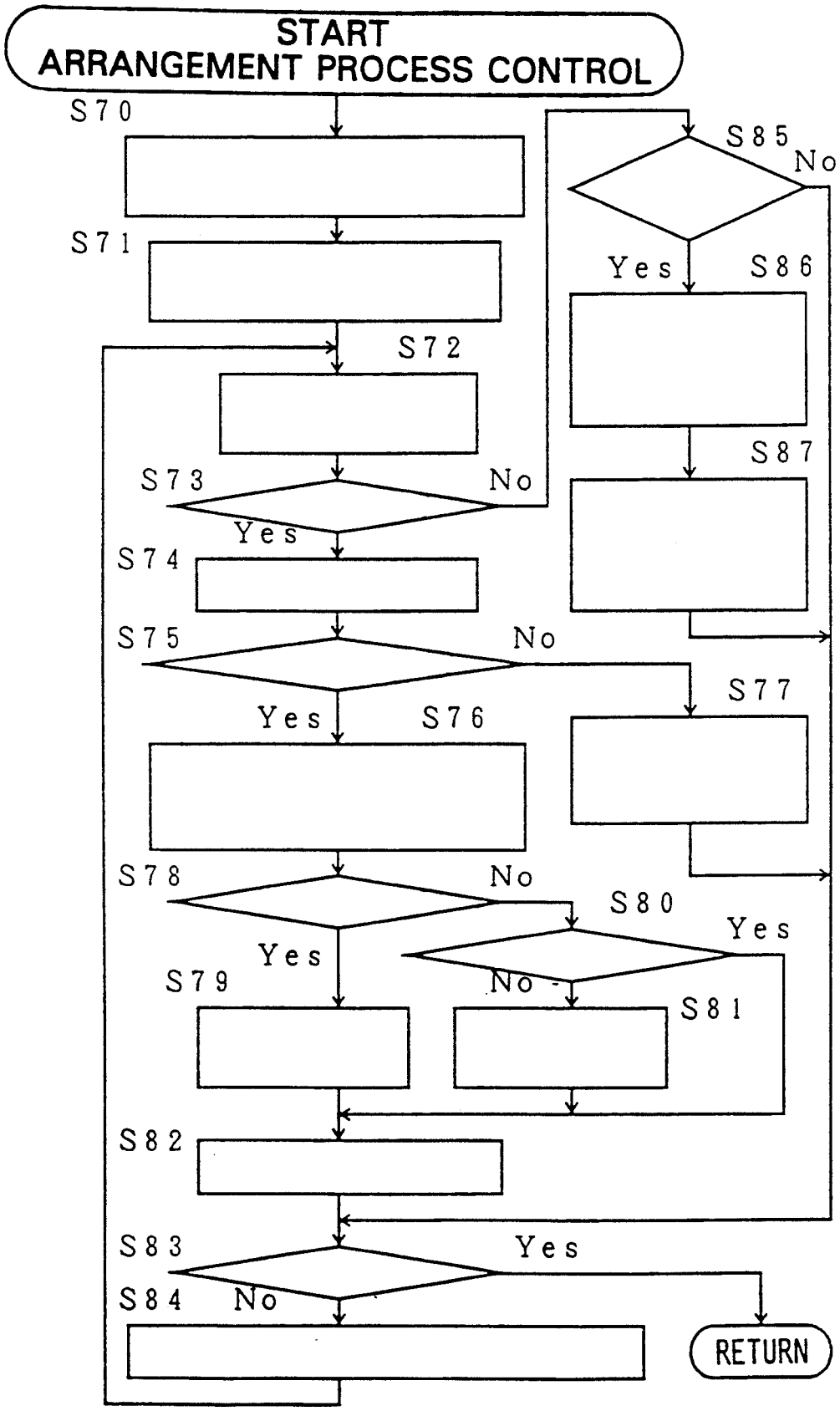
Figure 10A:
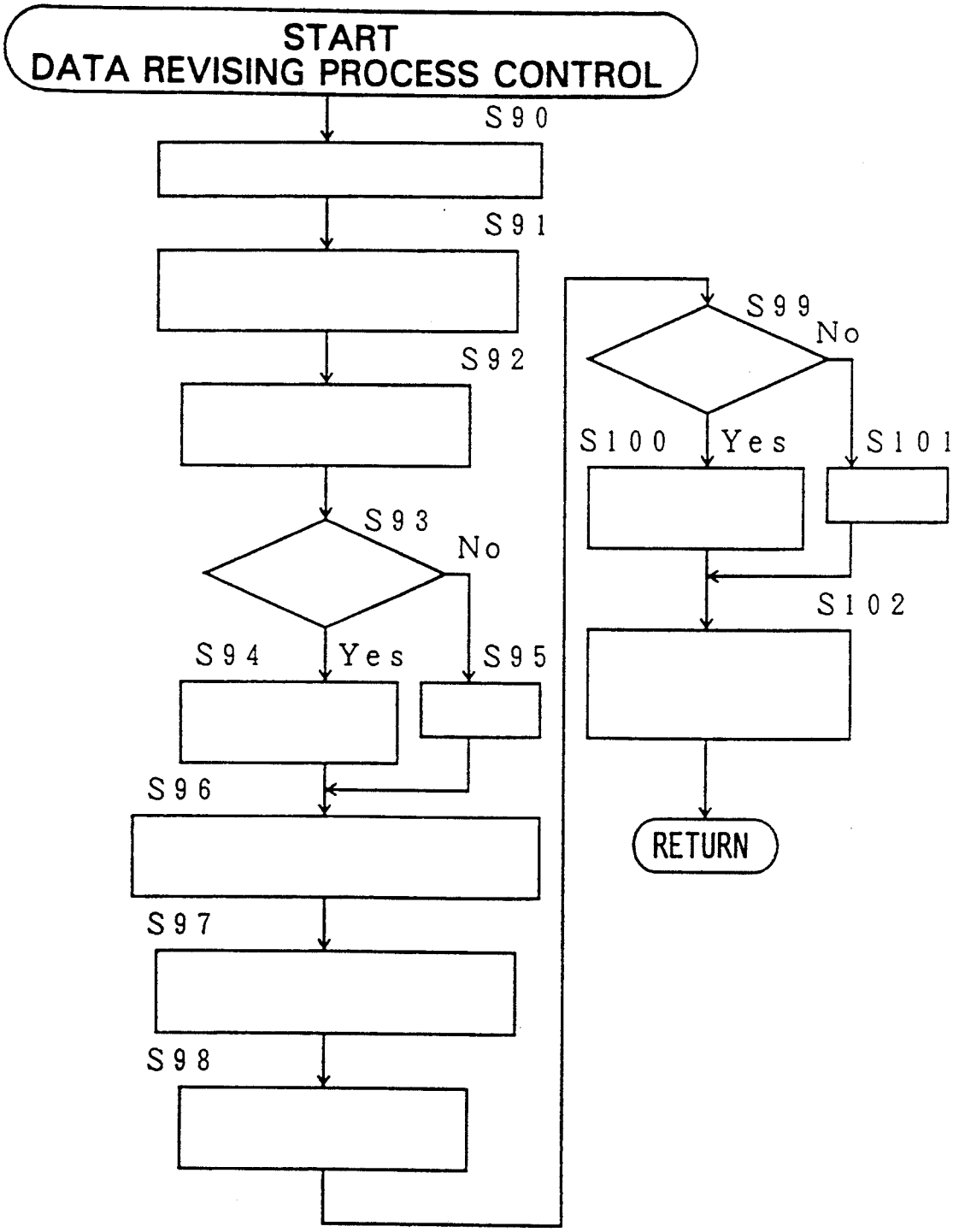

Control is then returned to the printing process control routine (FIG. 8A). In step S52, the start address of the first arrangement memory 32 is set to the first pointer P1. In step S53, data are read from the first arrangement memory 32 according to the first pointer P1. If, in step S54, the read data is the single-line printing command data, step S53 is followed by steps S54, S55, S56 and S57, in that order In step S57, the flag F1 is reset. In step S59, the L size character width (48 dots) used for single-line printing in accordance with the value of flag F1 is placed in the RAM 30. In step S60, the first pointer P1 is incremented, and step S53 is reached again. If the read data are the code for a character, for example, character "A", step S53 is followed by steps S54, S55 and S61 in that order. Step S61 sets a predetermined character spacing value of, for example, 3 dots. Since the flag F1 is found to be reset in step S62, step S63 and step S65 are reached. Step S63 reads the dot pattern data corresponding to the code data from the pattern data memory 29 and stores the dot pattern data into the printing buffer 37, as shown in FIG. 16. In step S65 character "A" is printed on the printing tape 9. In printing each character following the first character, after a predetermined character spacing value is set, the characters are printed.

If the read-out data are found to be the upper line printing command data, step S54 is followed by steps S55, S56 and S58, in that order. In step S58, the flag F1 is set. Step S58 is succeeded by step S59 which stores into the RAM 30 the SS size character width (16 dots) for double-line printing in accordance with the value of flag F1. Step S59 is again succeeded by S53 via step S60. In accordance with the described example, since the character "D" read in step S53 is an SS size character, S53 is followed by step S54, 55, and 61. Step S61 furnishes a character spacing value of, for example, 1 dot in accordance with the SS size characters for double-line printing. This character spacing value is selectively read from the ROM 28 in the same way that the character spacing value for L size characters is established. Since double-line printing is in effect, with the flag F1 found to be set in step S62, step S64 is then reached in which a data revising process control routine (see FIGS. 10A and 10B) is executed.

Figure 17:
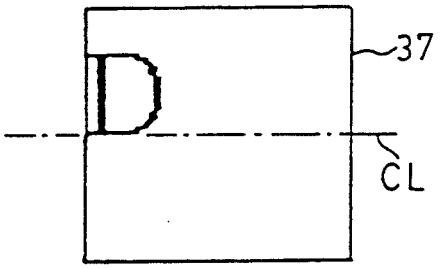
FIG. 17 is a view schematically depicting dot pattern data for a standard size character to be printed as upper line character data in a printing buffer.
Figure 18:
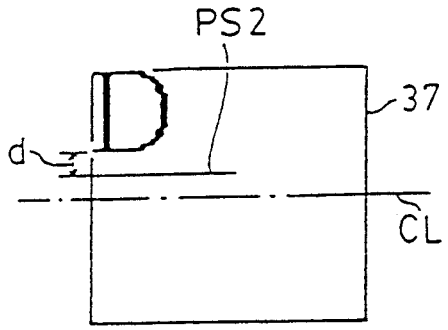
FIG. 18 is a view schematically depicting the dot pattern data of FIG. 17 in a printing buffer after the base line position has been changed.

When this routine is started, the address b0005 in the second arrangement memory 33 and corresponding to the first pointer P1 is assigned to the second pointer P2 in step S90. In step S91, the code data for the character "D" pointed to by the first pointer P1 are read out. Step S92 stores the dot pattern data of the above character code data into the location corresponding to the center line CL in the printing buffer 37, as illustrated in FIG. 17. Step S93 determines whether a printing base line position change amount "d" is included in the upper line printing command data. If the result of S93 is affirmative, step S94 is reached in which the base line position change amount "d" (+4 dots) is read and stored in a base line change memory 36. Step S96 shifts the above dot pattern data in the dot column direction by the dot count obtained by adding the base line position change amount "d" to the "4 dots" for originally shifting the dot pattern data toward the normal printing base line position PS2 of the upper line, as depicted in FIG. 18. Since the amount "d" is 4 with the first embodiment, the character "D" in FIG. 18 is stored after being shifted 4 dots above the normal printing base line position PS2 of the upper line.

Figure 19:
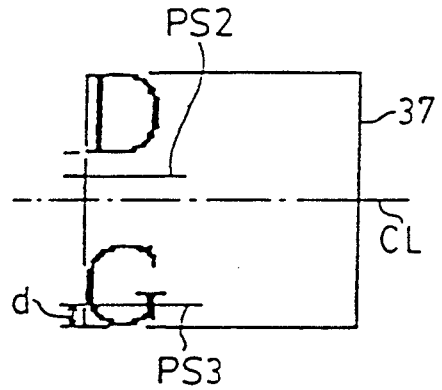
FIG. 19 is a view schematically depicting the dot pattern data of FIG. 18 after dot pattern data for another standard size character to be printed in a lower line is entered into a printing buffer.

In step S97, the code data for the character "G" pointed to by the second pointer P2 are read out. Step S98 revises and stores the dot pattern data of the above character code data into the lower position within the printing buffer 37, as shown in FIG. 19. Step S99 determines whether the lower line printing command data include the printing base line position change amount "d". If the result of S99 is affirmative, step S100 is reached in which the base line position change amount "d" (−4 dots) is read out and stored in a base line change memory 36. Step S100 is followed by step S102. Step S102 shifts the above dot pattern data in the dot column direction by the dot count obtained by adding the base line position change amount "d" to the "4 dots" for originally shifting the dot pattern data toward the normal printing base line position PS3 of the lower line. Then the data revising process control routine is terminated, and control is returned to FIG. 8A, step S64. Even if the data read out in S92 are the lower line printing command data, step S92 is followed by steps S93 through s102. If the results of the determinations in steps S93 or S99 are negative, the printing base line position change amount "d" is set to 0 and stored in the base line change memory 36 in steps S95 and S101. Since the amount "d" is −4 with the first embodiment, the character "G" in FIG. 19 is stored after being shifted 4 dots below the normal printing base line position PS3 of the lower line.

Figure 20:
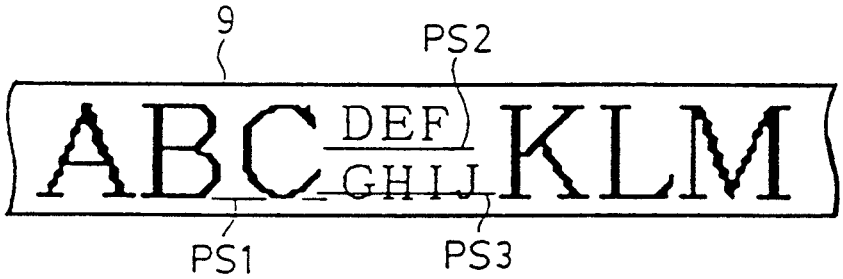
FIG. 20 is a view illustratively depicting single-line and double-line character strings printed on a printing tape, the characters being printed according to a printing base line position change amount.
Figure 21:
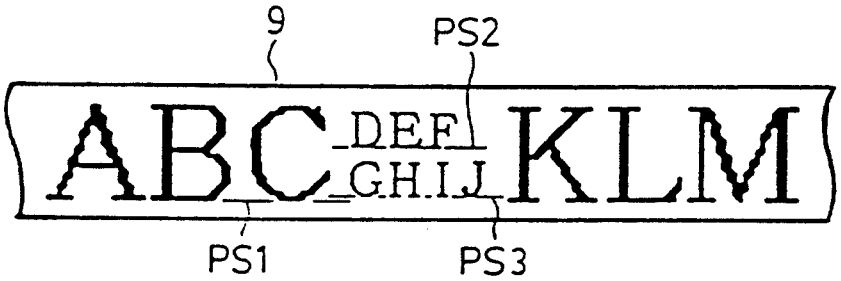
FIG. 21 is a view illustratively depicting single-line and double-line character strings printed on a printing tape, the characters being printed at preset (default) printing base line positions.

Thereafter, as shown in FIG. 19, step S65 (FIG. 8A) executes character printing in accordance with the dot pattern data for the two characters revised and stored in the printing buffer 37. Thus, all of the data held in the first and the second arrangement memories 32 and 33 as illustrated in FIG. 15 are printed under printing process control of steps S50 through S65 as described above. As illustrated in FIG. 20, a character string "ABC, KLM" is printed over the printing range PE in a single line on the printing tape 9; a character string "DEF" is printed in the upper printing line UL, and a character string "GHIJ" is printed in the lower printing line LL. Since heating element assembly extends across substantially the entire tape width, the character string in the upper printing line UL is printed simultaneously with the character string in the lower printing line LL, and thus the upper printing line is printed directly over the lower printing line. The character strings "DEF" and "GHIJ," when printed, are shifted from their original printing positions in accordance with the designated printing base line change amount "d". (It is helpful to shift the base line position when printing two lines so as to provide adequate spacing between the characters in adjacent lines. Additionally, changing the base line positions may help in centering the plural lines relative to the double size lines). If the data stored in the first and the second arrangement memories 32 and 33 shown in FIG. 15 are printed without any printing base line position change, the characters are printed on the printing tape 9 as shown in FIG. 21.

As a variation of the described embodiment, the pattern data memory 29 may contain the dot pattern data for three or four character sizes, any of which may be selected for single- and double-line printing.

Further, the entire printing area PE on the printing tape 9 can be divided into three or four printing lines, and any of these three or four printing lines can be selected for printing.

Another variation of the described embodiment is to supplement the printing buffer storing the dot string data with another printing buffer for accommodating the dot string data for the next printing pass. This enables the contents of the first printing buffer to be output and printed while the next characters are being input and revised in the second printing buffer, thus increasing an operating speed of the tape printer.

As mentioned above, the print area PE of the printing tape 9 which corresponds to the length of the heating element assembly of the thermal head 7, is divided into the upper printing line UL and the lower printing line LL. The identification of either of these two print lines UL and LL, the printing position within a print line, and the character code data of the characters input for a print line by either the upper line printing command data or the lower line printing command data, respectively, are stored in the input data buffer 31. The code data for characters to be printed in the upper printing line UL based on the upper line printing command data are arranged in the first arrangement memory 32. The code data for characters to be printed in the lower printing line LL based on the lower line printing command data are arranged in the second arrangement memory 33. The dot pattern data of two code data arranged in both first and second arrangement memories 32 and 33 are revised in the printing buffer 37. Characters are printed on the printing tape 9 based on the revised dot pattern data. Thus, the input characters can be printed simultaneously in the desired printing line (i.e., the upper printing line UL and the lower printing line LL). Accordingly, many more characters can be printed over both the upper printing line UL and the lower printing line LL than was previously possible.

Although the description above contains many specificities, these should not be construed as limiting the scope of the invention but as merely providing illustrations of some of the presently preferred embodiments of this invention. For example, the invention may also be embodied as a tape printer that requires the printing tape 9 to be drawn out manually as characters are being printed thereon. Another alternative example could employ a wire dot type tape printer, or any of many other tape printers.

Additionally, the specific keys described for performing specific functions are merely illustrative; other key combinations, or other input means could also be used. Additionally, the specific symbols represented on the display could differ from what was described above.

Furthermore, data for the single printing line and upper printing line could be directly stored into first arrangement memory 32, and data for the lower line could be directly stored into the second arrangement memory 33, thus eliminating the input data buffer 31.

Thus the scope of the invention should be determined by the appended claims and their legal equivalents, rather than by the examples given.

What is claimed is:

1. A tape printing device for printing a plurality of lines of characters on a print medium tape comprising:

character input means for enabling a user to input character data;

command input means for enabling a user to input command data specifying on which single one of the plurality of lines a particular input character is to be printed, said command input means including means enabling the printing of different characters on each of said plurality of lines, said plurality of lines being located adjacent to each other across the width of said tape so that separate characters can be printed simultaneously in said plurality of lines without said separate characters overlapping each other;

an input data buffer for storing the data input from said character and command input means;

a printing head for printing characters on a print medium tape;

printing setting means, responsive to the command data input from said command data input means, for selectively setting each particular input character in one of said plurality of printing lines according to the command data associated with each particular input character, in accordance with the data stored in said input data buffer;

data arrangement means for arranging the character data stored in said input data buffer in order to enable the printing of a plurality of printing lines of characters directly adjacent to each other across the tape width according to a printing line set by said printing setting means; and controlling means for controlling said printing head based on the data arranged by said data arrangement means.

2. A tape printing device according to claim 1, further comprising:

pattern data storing means for storing dot pattern data for a plurality of characters; wherein said controlling means includes:

a printing buffer for receiving and storing the dot pattern data from said pattern data storing means corresponding to the character data arranged by said data arrangement means; and data revising means for receiving the dot pattern data from said pattern data storing means and for revising a dot pattern data group of the character data arranged by said data arrangement means so that the plurality of printing lines of the characters can be printed directly adjacent to each other across said tape width.

3. A tape printing device according to claim 2, further comprising:

a display means for displaying the data input from said character and command input means.

4. A tape printing device according to claim 3, wherein said display means includes a means for displaying a printing line mark indicating the printing line set by said printing setting means according to the command data input from said command input means.

5. A tape printing device according to claim 4, wherein said display means includes a means for displaying the character data of characters input from said character input means following the printing line mark in response to input of the character data from said character input means.

6. The tape printing device of claim 1, wherein said data arrangement means includes a plurality of arrangement memories, each of said plurality of arrangement memories corresponding to one of said plurality of printing lines.

7. The tape printing device of claim 6, wherein said printing setting means is capable of setting one of an upper printing line and a lower printing line, said data arrangement means includes an upper line arrangement memory and a lower line arrangement memory, and said controlling means controls said printing head to print characters in said lower printing line directly below characters in said upper printing line.

8. The tape printing device of claim 1, wherein said printing head has a length substantially the same as the tape width so that said printing head can print the plurality of printing lines simultaneously.

9. The tape printing device of claim 1, wherein said data arrangement means inserts space data into the character data for at least one of the plurality of printing lines so that the plurality of printing lines have equal lengths.

10. The tape printing device of claim 1, further comprising:

line mode selecting means for selecting between a single line printing mode wherein a single printing line can be printed across the tape width, and a plural line mode wherein the plurality of lines set by said printing setting means can be printed directly adjacent to each other across the tape width.

11. A tape printing device for printing a plurality of lines of characters on a print medium tape by controlling a printing head to print successive dot lines onto the print medium tape, each dot line extending across a width of the tape, said tape printing device comprising:

character input means for enabling a user to input character data;

command input means for enabling a user to input command data specifying on which single one of the plurality of lines a particular input character is to be printed, said command input means including means enabling the printing of different characters on each of said plurality of lines, said plurality of lines being located adjacent to each other across the width of said tape so that separate characters can be printed simultaneously in said plurality of lines without said separate characters overlapping each other;

printing setting means, responsive to printing line setting command data input from said command input means, for selectively setting each particular input character in one of said plurality of printing lines, according to the command data associated with each particular input character;

data arrangement means for arranging character data, input from said character input means according to the printing line set for the character data by said printing setting means, and storing said arranged character data; and controlling means for controlling the printing head based on the data arranged by said data arrangement means.

12. The tape printing device of claim 11, wherein said controlling means includes:

data revising means for revising dot pattern data groups, comprised of a plurality of successive dot lines and read into said data revising means from a pattern data storing means containing dot pattern data for a plurality of characters, of the character data arranged by said data arrangement means so that the plurality of printing lines of the characters can be printed directly adjacent to each other across said tape width; and a printing buffer for storing the dot pattern data groups revised by said data revising means.

13. A tape printing device according to claim 11, further comprising:

a display means for displaying the data input from said character and command input means.

14. A tape printing device according to claim 13, wherein said display means includes a means for displaying a printing line mark indicating the printing line set by said printing setting means according to the command data input from said command input means.

15. A tape printing device according to claim 14, wherein said display means includes a means for displaying the character data of characters input from said character input means following the printing line mark in response to input of the character data from said character input means.

16. The tape printing device of claim 11, wherein said printing setting means is capable of setting one of an upper printing line and a lower printing line, said data arrangement means includes an upper line arrangement memory and a lower line arrangement memory, and said controlling means controls said printing head to print characters in said lower printing line directly below characters in said upper printing line.

17. The tape printing device of claim 11, wherein said printing head has a length substantially the same as the tape width so that said printing head can print the plurality of printing lines simultaneously.

18. The tape printing device of claim 11, wherein said data arrangement means inserts space data into the character data for at least one of the plurality of printing lines so that the plurality of printing lines have equal lengths.

19. The tape printing device of claim 11, further comprising:

base line positioning means for setting a base line position for each printing line set by said printing setting means.

20. A tape printing device for printing a plurality of lines of characters on a print medium tape across a tape width comprising:

character input means for enabling a user to input character data;

command input means for enabling a user to input command data specifying on which single one of the plurality of lines a particular input character is to be printed, said command input means including means enabling the printing of different characters on each of said plurality of lines, said plurality of lines being located adjacent to each other across the width of said tape so that separate characters can be printed simultaneously in said plurality of lines without said separate characters overlapping each other;

an input data buffer for storing the data input from said input means;

a printing head for printing characters on a print medium tape;

mode setting means, responsive to the command data for selecting between a single line printing mode wherein a single printing line can be printed across the tape width and a plural line printing mode wherein said plurality of lines can be printed directly adjacent to each other across the tape width, said mode setting means for setting the plural line mode when the command input means is used to specify separate characters to be printed on different ones of said plurality of lines;

data arrangement means for arranging the character data stored in said input data buffer in order to enable the printing of a plurality of printing lines of characters directly adjacent to each other across the tape width when said mode setting means sets the plural line mode; and controlling means for controlling said printing head based on the data arranged by said data arrangement means.

21. The tape printing device of claim 20, further comprising:

printing setting means for selectively setting input characters in at least one of a plurality of printing lines, defined by dividing a printing area across the width of the printing medium tape into the plurality of printing lines, in accordance with the data stored in said input data buffer, and wherein said data arrangement means arranges the character data according to a printing line set by said printing setting means.

22. The tape printing device of claim 21, further comprising:

pattern data storing means for storing dot pattern data for a plurality of characters;

wherein said controlling means includes:

a printing buffer for receiving and storing the dot pattern data from said pattern data storing means corresponding to the character data arranged by said data arrangement means; and data revising means for receiving the dot pattern data from said pattern data storing means and for revising a dot pattern data group of the character data arranged by said data arrangement means so that the plurality of printing lines of the characters can be printed directly adjacent to each other across said tape width.

23. The tape printing device of claim 22, further comprising:

a display means for displaying the data input from said input means.

24. The tape printing device of claim 20, wherein said printing head has a length substantially the same as the tape width so that said printing head can print the plurality of printing lines simultaneously.

* * * * *